United States Patent [19]

Burton, III

[11] 4,148,710

[45] Apr. 10, 1979

[54] FLUIDIZED BED PROCESS FOR RETORTING OIL SHALE

[75] Inventor: Robert S. Burton, III, Grand Junction, Colo.

[73] Assignee: Occidental Oil Shale, Inc., Grand Junction, Colo.

[21] Appl. No.: 805,883

[22] Filed: Jun. 13, 1977

[51] Int. Cl.[2] ..... C10G 1/02

[52] U.S. Cl. ..... 208/11 R; 201/16; 201/31; 202/116; 208/164

[58] Field of Search ..... 208/11 R, 164; 201/16, 201/31

[56] References Cited

U.S. PATENT DOCUMENTS

| | | | |
|---|---|---|---|
| 2,432,298 | 12/1947 | Eastwood et al. | 208/164 |
| 2,626,234 | 1/1953 | Barr et al. | 201/16 |
| 2,673,177 | 3/1954 | Buell | 202/14 |
| 2,697,688 | 12/1954 | Nicolai | 208/11 R |
| 2,752,292 | 6/1956 | Scott | 208/11 R |
| 2,908,617 | 10/1959 | Murphree | 202/14 |
| 2,989,442 | 6/1961 | Dorsey | 201/16 |
| 3,297,562 | 3/1964 | Biddick et al. | 208/11 R |
| 3,484,364 | 12/1969 | Hemminger | 208/11 R |
| 3,617,468 | 11/1971 | Reyburn et al. | 208/11 R |
| 3,776,838 | 12/1973 | Youngblood et al. | 208/164 |

*Primary Examiner*—Herbert Levine

*Attorney, Agent, or Firm*—Christie, Parker & Hale

[57] ABSTRACT

Oil shale is pyrolyzed by introducing an oil shale feed to a retorting zone fluidized bed to yield, as products of retorting, retorted oil shale containing residual carbonaceous material and volatilized hydrocarbons. The retorted oil shale particles are passed to the top of a combustion zone fluidized bed into which a gaseous source of oxygen is introduced for fluidizing the combustion zone fluidized bed and oxidizing residual carbonaceous material contained in the retorted oil shale particles to yield combustion gases for fluidizing the retorting zone fluidized bed and for maintaining the retorting zone fluidized bed at a temperature sufficient to retort oil shale.

4 Claims, 1 Drawing Figure

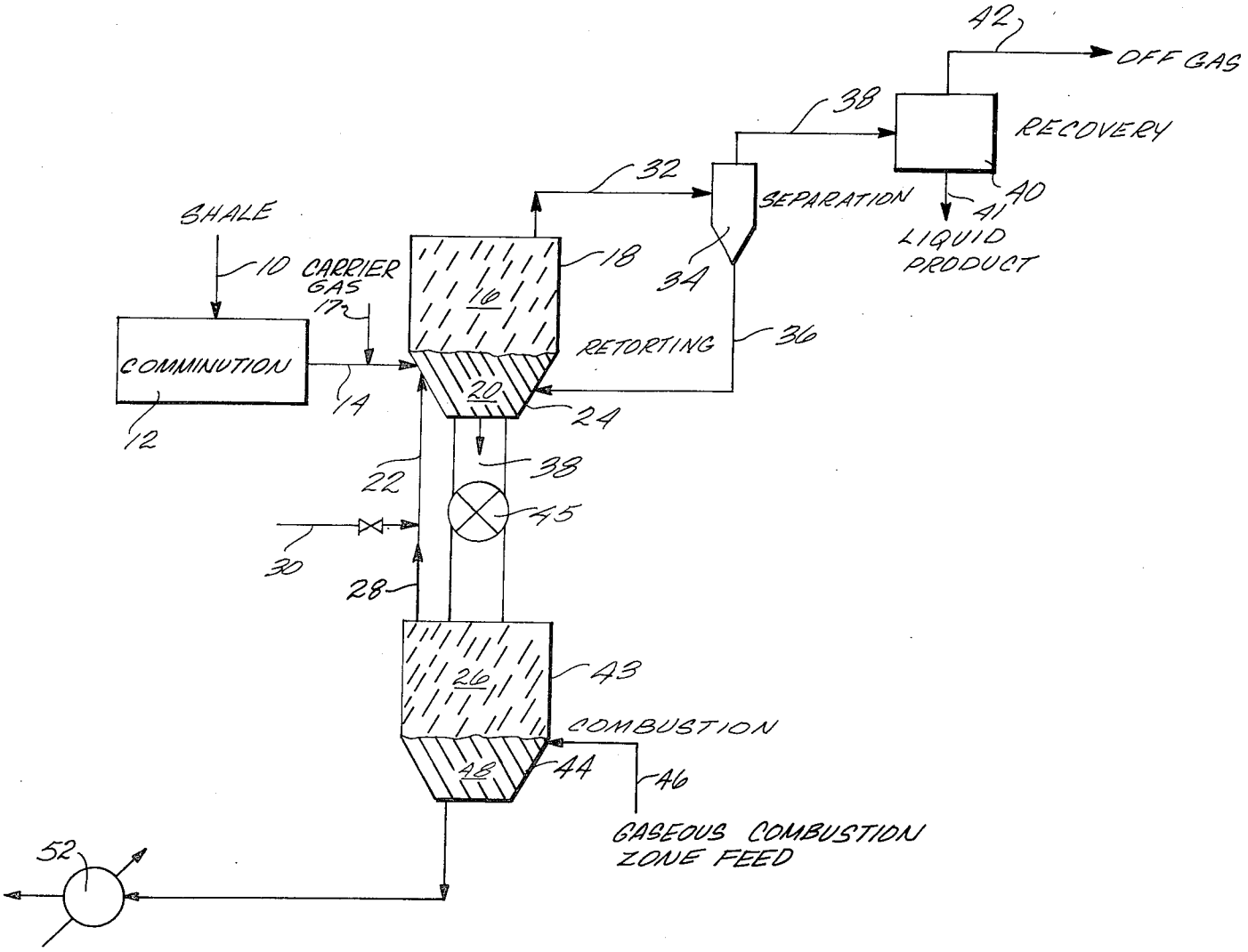
OFF GAS
RECOVERY
42
40
41
LIQUID PRODUCT
38
SEPARATION
34
36
32
16
RETORTING
24
18
20
38
45
43
COMBUSTION
46
GASEOUS COMBUSTION ZONE FEED
44
26
48
22
28
30
CARRIER GAS
14
SHALE
10
COMMINUTION
12
52

FLUIDIZED BED PROCESS FOR RETORTING OIL SHALE

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in situ.

The recovery of liquid and gaseous products by processing oil shale in situ has been described in several patents, one of which is U.S. Pat. No. 3,661,423, issued May 9, 1972 to Donald E. Garrett, and assigned to the assignee of this application. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to as an in situ oil shale retort. Hot retorting gases are passed through the in situ oil shale retort to convert kerogen contained in the oil shale to liquid and gaseous products.

Rather than discarding such mined oil shale, it is desirable to retort the mined oil shale above ground to recover liquid and gaseous hydrocarbon materials. Exemplary of processes for retorting oil shale above ground is the process described in U.S. Pat. No. 2,908,617 issued to Murphree. In this process, raw oil shale is heated to produce kerogen decomposition, called retorting, in the oil shale to gaseous and liquid products and a residue of solid carbonaceous material. In the Murphree process the heat for retorting is obtained by oxidizing residual carbonaceous material in the retorted oil shale in a combustion zone with concomitant generation of a flue gas. The heat content of the flue gas is not utilized. Hot shale formed in the combustion zone is cycled to the retorting zone to provide the heat necessary for retorting.

Processes such as that of Murphree are thermally inefficient because the heat content of the flue gas is lost from the process. This can reduce the yield of hydrocarbons obtained from the oil shale because instead of using the thermal energy of the flue gas for retorting oil shale, thermal energy for retorting oil shale is obtained by oxidation of hydrocarbon products.

Therefore, there is a need for a high efficiency method for recovery of hydrocarbon values from oil shale.

SUMMARY OF THE INVENTION

According to the present invention, there is provided a process in which particulate oil shale feed containing carbonaceous material is introduced to a retorting zone fluidized bed. Preferably the particulate oil shale feed is substantially uniformly sized and consists essentially of particles capable of passing through a one-half inch sieve to obtain fast heating in the retorting zone fluidized bed. The retorting zone fluidized bed is fluidized by an upward flow of combustion gases substantially free of free oxygen so that they do not react with products of retorting in a deleterious manner. The combustion gases maintain the fluidized bed at a temperature sufficient to retort oil shale to yield, as products of retorting, retorted oil shale containing residual carbonaceous material and volatilized hydrocarbons.

The retorted oil shale particles containing residual carbonaceous material are passed from the retorting zone fluidized bed, and preferably from the bottom of the retorting zone fluidized bed, downwardly to the top of a combustion zone fluidized bed. Mechanical means such as a rotary vane feeder can be used to assist in the transfer of the retorted oil shale particles between the two fluidized beds.

A gaseous source of oxygen is introduced upwardly into the combustion zone fluidized bed for fluidizing the combustion zone fluidized bed and for oxidizing residual carbonaceous material contained in the retorted shale particles present in the combustion zone fluidized bed. This yields combusted oil shale and combustion gases. The combustion gases are used for fluidizing the retorting zone fluidized bed and for maintaining the retorting zone fluidized bed at a temperature sufficient to retort oil shale. Combusted oil shale particles are withdrawn from the combustion zone fluidized bed. The heat contained in these particles can be used to preheat the incoming gaseous source of oxygen.

The retorting zone fluidized bed and combustion zone fluidized bed can be in separate vessels. When separate vessels are used, preferably the vessel containing the retorting zone fluidized bed is directly above the vessel containing the combustion zone fluidized bed for ease of transferring retorted oil shale between the vessels.

A vapor mixture comprising combustion gases and volatilized hydrocarbons produced by retorting is withdrawn from the retorting zone fluidized bed. The vapor mixture can contain entrained retorted oil shale particles which can be separated from the vapor mixture by gas/solids separation means such as a cyclone. The separated retorted oil shale particles can then be recycled to the retorting zone fluidized bed and/or the combustion zone fluidized bed. Hydrocarbons can be condensed from the separated vapor mixture leaving an off gas which can have a sufficiently high heating value to be burned for power generation.

DRAWING

These and other features, aspects and advantages of the present invention will become more apparent upon consideration of the following description, appended claims, and accompanying drawing which schematically represents a process embodying features of this invention for retorting oil shale.

DESCRIPTION

With reference to the drawing, raw oil shale 10 containing carbonaceous material, i.e., kerogen, is introduced to a comminution apparatus 12. In the comminution apparatus the oil shale is comminuted to form a particulate feed 14 of substantially uniform size for ease in fluidization in subsequent processing. Preferably the oil shale 10 is comminuted so that the oil shale feed 14 consists essentially of particles passing through a one-half inch sieve to allow rapid retorting and to permit easy fluidization of the particles during subsequent retorting and combustion operations. As used herein, the term "comminution" refers to any physical act of size reduction, including, but not limited to crushing and grinding by suitable machinery. During the comminution of the raw oil shale preferably production of fines is minimized. As described below, fines produced during comminution can be entrained by gaseous products of retorting, and these fines can then contaminate hydrocarbon products produced according to this process. Separation of fines from the comminuted oil shale such as by screening can be required after comminution to remove fines from the feed.

The particulate raw oil shale feed 14 is introduced to a lower portion such as the base of a retorting zone fluidized bed 16 contained in a vessel 18 for retorting to yield, as products of retorting, retorted oil shale containing residual carbonaceous material and volatilized hydrocarbons. As described below, residual carbonaceous material contained in the retorted oil shale particles is oxidized in a combustion zone fluidized bed to yield combusted oil shale.

As used herein, the term "combusted oil shale" refers to oil shale of reduced carbon content due to oxidation by a gas containing free oxygen. The term "retorted oil shale" refers to oil shale heated to a sufficient temperature to decompose kerogen in an environment substantially free of free oxygen so as to leave a solid residual carbonaceous material. The term "raw oil shale" refers to oil shale which has not been subjected to any process for decomposing kerogen in the oil shale.

The particulate oil shale feed 14 can be conveyed into the retorting zone fluidized bed 16 by a carrier gas 17 which does not deleteriously react with products of retorting. As used herein, by a gas which does not deleteriously react there is meant a gas stream which is substantially or essentially free of free oxygen. Although constituents of the gas may react with retorting products to upgrade their value; to be avoided are constituents which degrade retorting products. A carrier gas can be for example, an off gas product of retorting, any desired inert gas, steam or mixtures thereof. When the carrier gas contains steam, the steam can react under suitable conditions with residual carbonaceous material in retorted oil shale to yield by the water-gas shift reaction, hydrogen and carbon monoxide which can react with and stabilize unsaturated hydrocarbons in the products of retorting.

The upper portion of the vessel 18 containing the retorting zone fluidized bed 16 can be expanded (not shown) for disengagement of oil shale particles from the fluidizing gas. The bottom 24 of this vessel 18 has a frustoconical shape. The fluidized bed can be supported by a perforated gas distributer plate (not shown). Below the distributer plate in the vessel 18 in this conical portion 24 is a bed 20 containing oil shale particles retorted in the retorting zone fluidized bed 16.

The retorting zone fluidized bed 16 is fluidized by an upward flow therethrough of a fluidizing gas stream 22 introduced into the vessel 18 at the base of the retorting zone fluidized bed 16. Preferably the fluidizing gas 22 is a gas which does not deleteriously react with products of retorting. As described below, at least a portion of the fluidizing gas 22 includes combustion gases 28 generated from oxidation of retorted oil shale in a combustion zone fluidized bed 26.

This is an advantageous use of the combustion gases because the thermal energy of the combustion gases is recovered for retorting oil shale feed. In prior art processes the thermal energy of the combustion gases is not utilized.

The fluidizing gas 22 can be distributed at the base of the retorting zone fluidized bed 16 by conventional means such as a gas distribution plate or distribution ring (not shown). The fluidizing gas is provided at a sufficient rate to fluidize the particulate oil shale feed 14 introduced to the vessel 18. In the event that inadequate combustion gases 28 are provided from the combustion zone fluidized bed 26 to fluidize the oil shale feed 14, the combustion gases 28 can be supplemented by a gas stream 30 which does not deleteriously react with retorting products.

The fluidizing gas is supplied at a rate and a temperature consonant with maintaining the temperature in the retorting zone fluidized bed 16 suitable for retorting. Retorting of oil shale can be conducted at temperatures above about 400° F. As the temperature of retorting increases, the particulate oil shale feed is heated faster, which can increase the rate of recovery of hydrocarbon products from the oil shale. Therefore, preferably the retorting zone fluidized bed is maintained at as high a temperature as possible. Retorting at a temperature higher than the temperature at which combustion gases 28 for fluidizing can be provided from the combustion zone fluidized bed 26 can be effected by externally heating the vessel 18 containing the retorting zone fluidized bed and/or introducing a high temperature gas into the retorting zone fluidized bed. The maximum temperature of the retorting zone fluidized bed is determined by the fusion temperature of oil shale, which is about 2100° F. The temperature in the retorting zone fluidized bed preferably is maintained below about 1800° F. to provide a margin of safety between the temperature of the retorting zone and the fusion temperature of the oil shale.

Preferably the gas residence time in the retorting zone fluidized bed is less than about 5 seconds, and more preferably less than about 2 seconds, to limit cracking of the hydrocarbon products of retorting. To achieve very short gas residence times in the retorting zone fluidized bed, such high gas velocities can be required that excessive entrainment of solids by gaseous products of retorting of the oil shale feed can occur with resultant solids contamination of hydrocarbon products. Therefore, preferably the gas residence time in the retorting zone fluidized bed is greater than about 0.1 second, and more preferably greater than about 0.5 second. A gas residence time in the retorting zone fluidized bed of from about 0.1 to about 5 seconds is preferred, and more preferred is a gas residence time of from about 0.5 to about 2 seconds.

Heating of the particulate oil shale feed by the fluidizing gas in the retorting zone fluidized bed 16 results in retorting of the kerogen in the oil shale particles. This retorting generates products such as carbon dioxide, carbon monoxide, hydrogen, water, and volatilized hydrocarbons having a wide range of boiling points such as methane having a boiling point of −259° F. to tars having a boiling point over 1000° F. A vapor mixture comprising these products of retorting and fluidizing gas, including combustion gases, is withdrawn from the top of the vessel 18. In addition, entrained retorted oil shale particles, particularly fines, are carried overhead by the vapor mixture. This combined stream of the vapor mixture and entrained particles is passed via line 32 to a separation zone 34 such as one or more cyclone separators in series or parallel. The entrained retorted oil shale particles are separated from the vapor mixture in the separation zone 34 to avoid contamination of the hydrocarbon products of retorting and are recycled to the bottom portion 24 of the retorting zone vessel 18 via line 36. The separated entrained particles can also be introduced to the combustion zone fluidized bed 20.

The vapor mixture, either before or after separation from entrained solids, can be used to preheat the oil shale bed, thereby advantageously recovering some of the thermal energy of the vapor mixture.

The vapor mixture 38 separated in the separation zone 34 is transferred to a recovery operation 40 where liquid products 41 comprising condensible hydrocarbons in the vapor mixture are separated and recovered by separation and recovery means such as venturi scrubbers, indirect heat exchangers, wash towers and the like. The liquid product stream 41 recovered in the recovery operation 40 also includes water which can be separated from hydrocarbon products by methods such as decanting. An off gas 42 from the recovery operation contains constituents such as carbon dioxide, carbon monoxide, hydrogen, hydrogen sulfide, and hydrocarbons having a low boiling point such as methane and ethane. The off gas can be used as the supplementary gas 30 for the retorting zone fluidizing gas stream 22, as the carrier gas 17 for the particulate oil shale feed 14 or sold as a product gas. Undesirable components such as hydrogen sulfide can be removed from the off gas by chemical scrubbing and then the off gas can be burned to produce steam or power. If high energy off gas is desired for power generation, a portion of the condensible hydrocarbons can be left in the off gas.

Retorted oil shale particles in the bed 20 in the bottom portion 24 of the retorting zone vessel 18 are passed downwardly through line 38 into the top of a vessel 43 containing the combustion zone fluidized bed 26. The combustion zone vessel 43 has substantially the same shape as the retorting zone vessel 18, including a frustoconical bottom portion 44, and if desired, an expanded top portion (not shown) for disengagement of combusted oil shale from fluidizing gases. Preferably the vessel 18 containing the retorting zone is directly above the vessel 43 containing the combustion zone for ease of transfer of retorted oil shale particles into the top of the combustion zone fluidized bed. To transfer the retorted oil shale between the two vessels, a rotary-vane feeder 45 such as a star valve can be provided. This feeder 45 can be controlled to maintain the bed 20 of retorted oil shale at a desired level in the retorting zone vessel 18.

A gaseous combustion zone feed 46 containing an oxygen supplying gas is introduced upwardly into the combustion zone fluidized bed 26 for fluidizing the combustion zone fluidized bed and for oxidizing at least a portion of the residual carbonaceous material contained in the retorted oil shale particles present in the combustion zone. This yields combusted oil shale and combustion gases for fluidizing the retorting zone fluidized bed 16 and for maintaining the retorting zone fluidized bed at a temperature sufficiently high for retorting of oil shale.

To uniformly distribute the gaseous combustion zone feed 46 through the combustion zone fluidized bed, distribution means such as a distributor ring (not shown) can be used.

The combusted oil shale produced in the combustion zone fluidized bed is collected in a bed 48 at the bottom 44 of the vessel 43 and continually withdrawn at a rate controlled to maintain a combusted oil shale bed 48 of substantially constant height in the vessel 43. The thermal energy of all or a portion of the withdrawn combusted oil shale can be recovered such as in a steam generation unit 52.

Because oil shale contains only a small amount of carbonaceous material, i.e., a maximum of about 80 gallons of oil per ton of oil shale as determined by Fischer assay, and more usually 25 to 35 gallons of oil per ton of oil shale, substantial amounts of combusted oil shale are withdrawn from the bottom of vessel 43. This is different from the situation with other potential carbon containing particulate sources of liquid hydrocarbons such as coal which contain predominately carbonaceous material and only a small portion of which is noncombustible. Therefore, there are significant solids handling problems associated with the retorting of oil shale and the transfer of retorted oil shale to a fluidized bed combustion zone. Use of fluidized beds and vertically spaced vessels 18 and 43 for the retorting and combustion zones, respectively, and a rotary vane feeder to transfer retorted oil shale from the retorting zone vessel 18 to the combustion zone vessel 43 helps overcome these solids handling problems.

The oxygen supplying gas in the gaseous combustion zone feed can be air, oxygen, and combinations thereof. The combustion zone feed can also contain diluents such as steam and inert gases such as nitrogen. The introduction of steam into the fluidized bed combustion zone 26 can lead to formation of hydrogen by reaction with residual carbonaceous material in the retorted oil shale according to the water-gas shift reaction. The hydrogen thus formed, when introduced to the retorting zone as a portion of the retorting zone fluidizing gas 22, can hydrogenate hydrocarbon products of retorting, thereby advantageously upgrading their value.

The rate of introduction of the gaseous combustion zone feed 46 is sufficient to maintain retorted oil shale particles in the combustion zone fluidized bed 43 fluidized. Sufficient oxygen is provided by the gaseous combustion zone feed 46 to maintain the combustion zone fluidized bed 26 at a temperature higher than the spontaneous ignition temperature of residual carbonaceous material contained in the retorted oil shale particles in the combustion zone fluidized bed. To this end, preferably the combustion zone feed 46 contains at least about 1% by volume oxygen. Air is the most economical source of oxygen. When air alone is used as the source of oxygen, the maximum oxygen concentration of the combustion zone feed is 20% by volume.

The combustion zone fluidized bed is maintained at as high a temperature as feasible to provide hot gas for maintaining the retorting zone fluidized bed at a high temperature for quick retorting of the particulate raw oil shale feed. The upper limit on the temperature of the combustion zone fluidized bed is determined by the fusion temperature of the oil shale, which is about 2100° F. The temperature in the combustion zone fluidized bed preferably is maintained below about 1800° F. to provide a margin of safety between the temperature in the combustion zone and the fusion temperature of the oil shale.

The gas stream 28 passing from the combustion zone fluidized bed 26 to the retorting zone fluidized bed 16 contains combustion gases generated in the combustion zone by oxidation of residual carbonaceous material in retorted oil shale, carbon dioxide produced by decomposition of alkaline earth metal carbonates such as calcium and magnesium carbonates contained in oil shale, and any unreacted portion of the gaseous combustion zone feed 46. This effluent gas 28 is substantially free of oxygen and contains carbon dioxide, carbon monoxide, water vapor, methane, traces of other hydrocarbons, and where air is used as a source of oxygen, nitrogen, argon and other nonreactive components of air. This gas stream 28 is advantageously used in a process according to this invention to provide the heat required for the endothermic retorting of the kerogen in the raw oil shale particles present in the retorting zone fluidized bed 16.

A process according to this invention has many advantages. For example, because retorting and combustion of carbonaceous material in oil shale occur in fluidized beds, high efficiency of conversion of kerogen to volatilized hydrocarbons results. It is possible to operate the combustion zone, and thus the retorting zone, at high temperatures and isothermally without agglomeration of the oil shale particles because the particles are surrounded by fluidizing gas, preventing tacky oil shale particles from contacting each other. Furthermore, by rapidly heating raw oil shale in the retorting zone fluidized bed, low residence time can be maintained in the retorting zone fluidized bed to avoid cracking of the hydrocarbon products of retorting. This can enhance liquid yields from the retorting operation. Also, unlike prior art processes the heat content of the combustion gases generated in the combustion zone is advantageously utilized for retorting oil shale.

Although this invention has been described in considerable detail with reference to certain versions thereof, other versions can be practiced. For example, although the invention has been described in terms of retorting and combustion zone fluidized beds contained in separate vessels, the two beds can be contained in a single vessel where the beds are separated by means such as a draft tube. Alternately, the retorting zone fluidized bed can be contained in a vessel which is contained in a vessel confining the combustion zone fluidized bed.

Because of variations such as these, the spirit and scope of the appended claims should not necessarily be limited to the description of the preferred versions contained herein.

What is claimed is:

1. A method for recovery of values from oil shale comprising the steps of:

(a) introducing particulate oil shale feed containing carbonaceous material to a retorting zone fluidized bed wherein the retorting zone fluidized bed is fluidized at least partly by an upward flow therethrough of combustion gases substantially free of free oxygen and which do not react with products of retorting in a deleterious manner, the combustion gases maintaining the retorting zone fluidized bed at a temperature sufficient to retort oil shale to yield, as products of retorting, retorted oil shale containing residual carbonaceous material and retorting vapors comprising volatilized hydrocarbons;

(b) passing retorted oil shale particles containing residual carbonaceous material from the bottom of the retorting zone fluidized bed downwardly to the top of a combustion zone fluidized bed by means of a rotary vane feeder;

(c) introducing a gaseous source of oxygen into the combustion zone fluidized bed for fluidizing the combustion zone fluidized bed and for oxidizing residual carbonaceous material contained in retorted oil shale particles present in the combustion zone fluidized bed to yield combusted oil shale and combustion gases;

(d) passing such combustion gases upwardly from the combustion zone fluidized bed to the retorting zone fluidized bed for fluidizing the retorting zone fluidized bed and for maintaining the retorting zone fluidized bed at a temperature sufficient to retort oil shale, wherein the combustion zone and retorting zone fluidized beds are contained in separate vessels, with the vessel containing the retorting zone fluidized bed being directly above the vessel containing the combustion zone fluidized bed, the upper portion of each vessel being expanded for disengagement of oil shale particles from fluidizing gas;

(e) withdrawing a vapor mixture of combustion gases and retorting vapors comprising hydrocarbons and entrained retorted oil shale particles from the retorting zone fluidized bed;

(f) separating entrained retorted oil shale particles from the vapor mixture;

(g) recycling separated retorted oil shale particles to one of said fluidized beds;

(h) condensing hydrocarbons from the vapor mixture; and (i) withdrawing combusted oil shale particles from the combustion zone fluidized bed.

2. A method as claimed in claim 1 comprising the additional step of recycling separated retorted oil shale particles to the retorting zone fluidized bed.

3. A method as claimed in claim 1 comprising the additional step of passing separated retorted oil shale particles to the combustion zone fluidized bed.

4. A method as claimed in claim 1 in which the vessel containing the retorting zone fluidized bed is contained in the vessel containing the combustion zone fluidized bed.

* * * * *